US007537469B2

(12) United States Patent
Takahashi et al.

(10) Patent No.: US 7,537,469 B2
(45) Date of Patent: May 26, 2009

(54) LEVER-FITTING TYPE CONNECTOR

(75) Inventors: Toshiharu Takahashi, Makinohara (JP); Motoyoshi Suzuki, Makinohara (JP); Kenji Kajikawa, Fujieda (JP); Akitoshi Sagisaka, Fujieda (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/146,536

(22) Filed: Jun. 26, 2008

(65) Prior Publication Data

US 2009/0023316 A1 Jan. 22, 2009

(30) Foreign Application Priority Data

Jul. 17, 2007 (JP) ..... 2007-185668

(51) Int. Cl.
*H01R 13/62* (2006.01)

(52) U.S. Cl. ..... 439/157

(58) Field of Classification Search ..... 439/157
See application file for complete search history.

(56) References Cited

U.S. PATENT DOCUMENTS 6,224,403 B1 * 5/2001 Okabe ..... 439/157
6,428,353 B2 * 8/2002 Mochizuki ..... 439/545
6,679,711 B2 * 1/2004 Takahashi ..... 439/157
7,442,058 B2 * 10/2008 Ohtaka et al. ..... 439/157

FOREIGN PATENT DOCUMENTS

JP 2003-249304 A 9/2003
JP 2005-122942 A 5/2005

* cited by examiner

*Primary Examiner*—Briggitte R Hammond
(74) *Attorney, Agent, or Firm*—Sughrue Mion, PLLC

(57) ABSTRACT

A housing 12 is connectable to a mating connector, and has inwardly-projecting housing bosses 41*a* and 41*b*. A lever 2 includes engagement portions 21*a* and 21*b* engageable respectively with the housing bosses 41*a* and 41*b*, and a lever boss 21*e* for retaining engagement with a retaining portion formed on the mating connector. Guide portions 21*c* and b 21*d* for guiding the insertion of the lever 2 into the housing 12 are formed at the lever 2, and a relief portion 41*c* for the passage of the lever boss 21*e* therethrough during the insertion is formed at the inside of the housing 12. At the time of starting the insertion of the lever 2 into the housing 12, the distance between each guide portion 21*c*, 21*d* and the corresponding housing boss 41*a*, 41*b* is smaller than the distance between the lever boss 21*e* and the relief portion 41*c*.

3 Claims, 8 Drawing Sheets

LEVER-FITTING TYPE CONNECTOR

BACKGROUND OF THE INVENTION

1. Field of the Invention

This invention relates to a lever-fitting type connector provided with a housing and a lever, and more particularly to a lever-fitting type connector in which the lever can be easily mounted on the housing, the housing being connectable to a mating connector.

2. Description of the Related Art

In one known conventional lever-fitting type connector of this kind, mounting grooves are provided so that a lever can be easily inserted into a housing at the time of mounting the lever on the housing (see Patent Literature 1). Namely, the mounting grooves formed in the lever extend respectively from engagement holes to peripheral edge portions of the lever along a direction of inserting of the lever. When the lever is mounted on the housing, housing bosses formed on the housing and serving as an axis of pivotal movement of the lever are engaged respectively in the engagement holes.

When inserting the lever into the housing, first, the worker introduces the housing bosses respectively into inlets of the mounting grooves formed respectively at the peripheral edge portions of the lever. Then, the worker pushes the housing bosses deep into the respective mounting grooves, and fits the housing bosses into the respective engagement holes provided respectively at inner ends of the mounting grooves, thus completing the insertion of the lever into the housing.

There is known another conventional lever-fitting type connector employing lever bosses (see Patent Literature 2). A lever is pivotally moved while the lever bosses are retainingly engaged respectively with retaining bosses formed on a mating connector, and by doing so, the fitting of the lever-fitting connector to the mating connector proceeds.

Patent Literature 1: JP-A-2003-249304 (Paragraph 0017, Paragraph 0022, FIG. 5, etc.)

Patent Literature 2: JP-A-2005-122942 (Paragraph 0078, FIG. 17, etc.)

However, there have been proposed various lever-fitting type connectors, and depending on the construction of the housing, much time has often been required for mounting the lever on the housing because of the lever bosses projecting laterally or perpendicularly from the lever-inserting direction.

For example, when the lever bosses move into the inside of the housing after the worker passes the lever bosses respectively through relief portions formed at lever-inserting surfaces of the housing, it is difficult to position the lever relative to the housing, and therefore much time has been required for the lever-mounting operation.

Even if the mounting grooves disclosed in the above Patent Literature 1 are merely applied to such a lever-fitting type connector, such mounting grooves often fail to effectively perform their function after the lever bosses move into the housing.

SUMMARY OF THE INVENTION

It is an object of this invention to provide a lever-fitting type connector which can solve the above problem.

A lever-fitting type connector of a first aspect of the invention comprises a housing, connectable to a mating connector, and having an inwardly-projecting housing boss; and a lever, including an engagement portion engageable with the housing boss, and a lever boss for retaining engagement with a retaining portion formed on the mating connector, wherein a guide portion for guiding the insertion of the lever into the housing is formed at the lever, and a relief portion for the passage of the lever boss therethrough during the insertion is formed at the inside of the housing; wherein, at the time of starting the insertion of the lever into the housing, the distance between the guide portion and the housing boss is smaller than the distance between the lever boss and the relief portion.

The lever-fitting type connector of a second aspect of the invention is characterized in that the guide portion includes a groove portion extending from the engagement portion to a peripheral edge of the lever along a direction of inserting of the lever.

The lever-fitting type connector of a third aspect of the invention is characterized in that the guide portion includes a notch portion formed in that portion of the peripheral edge of the lever aligned with the engagement portion in the direction of inserting of the lever.

In the lever-fitting type connector of the present invention, at the time when the worker inserts the lever into the housing, the guiding of the insertion by the guide portion is started, and thereafter the lever boss begins to pass through the relief portion. The guiding of the insertion by the guide portion is started at an initial stage of the insertion, and therefore the worker can smoothly mounted the lever on the housing in a short time.

DESCRIPTION OF THE PREFERRED EMBODIMENTS.

Preferred embodiments of the present invention will now be described with reference to the drawings.

First Embodiment

Figure 1A:
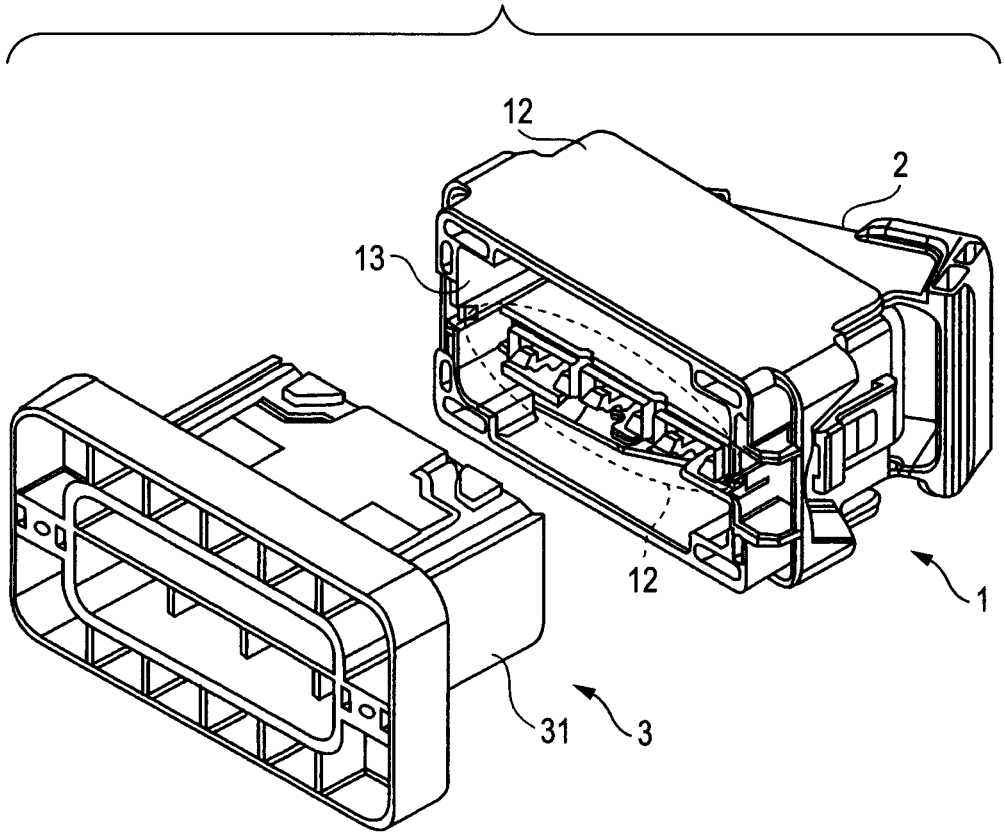
FIG. 1 A, B are perspective views showing a first embodiment of a lever-fitting type connector of the present invention and a mating connector.
Figure 1B:
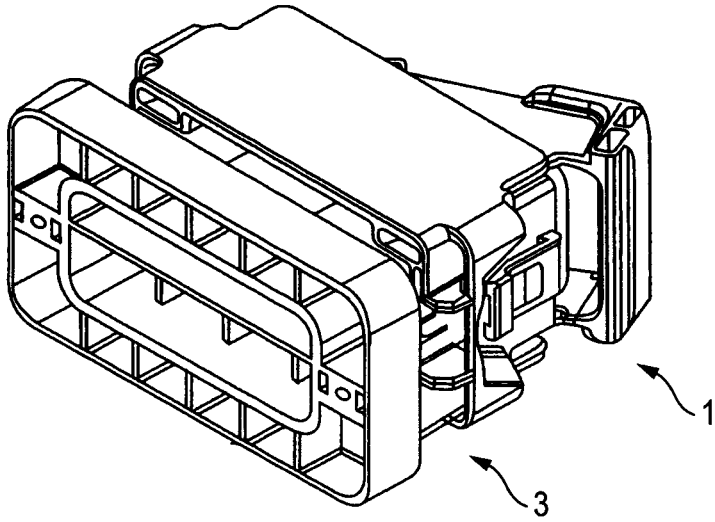

First, a first embodiment of a lever-fitting type connector of the invention as well as a mating connector will be briefly described. As shown in FIGS. 1A and 1B, the lever-fitting type connector 1 includes a female terminal-receiving portion 11, a housing 12, and a lever 2, and the mating connector 3 includes a male terminal-receiving portion (not shown), and a housing 31.

The female terminal-receiving portion 11 of the lever-fitting type connector 1 receives female terminals therein, and can be connected to the male terminal-receiving portion of the mating connector 3. A hood portion 13 is formed at the housing 12 in surrounding relation to the female terminal-receiving portion 11 so as to guide the fitting connection of this female terminal-receiving portion 11. The lever 2 can be pivotally moved relative to the housing 12 so as to assist the lever-fitting type connector 1 and the mating connector 3 to fit to each other (that is, to assist the female terminal-receiving portion 11 and the male terminal-receiving portion to fit to each other).

Figure 2:
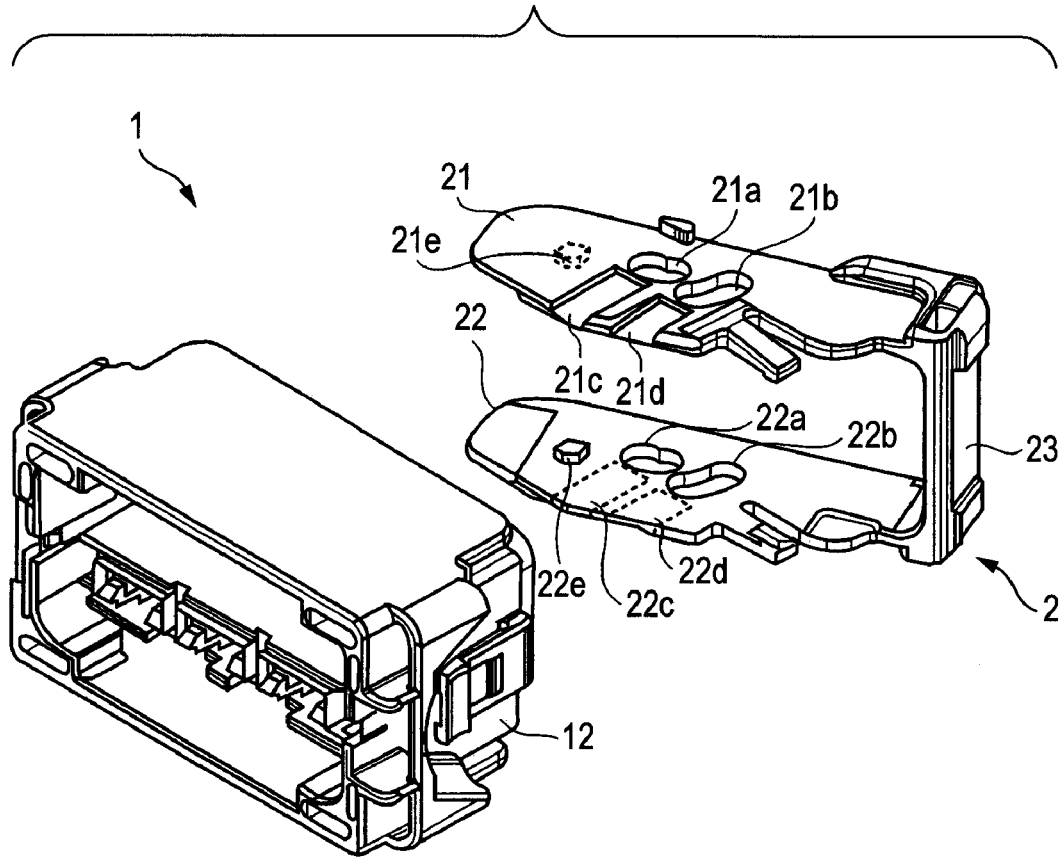
FIG. 2 is an exploded perspective view of the lever-fitting type connector.

More specifically, the lever 2 includes flat plate-like members 21 and 22, and an interconnecting member 23 as shown in FIG. 2. Each of the flat plate-like members 21 and 22 is formed into a flat plate-shape so as to be inserted into a space or gap between the female terminal-receiving portion 11 and the hood portion 13. The interconnecting member 23 interconnects the flat plate-like members 21 and 22 opposed at their side faces to each other so that these flat plate-like members 21 and 22 can be simultaneously pivotally moved relative to the housing 12.

Figure 3A:
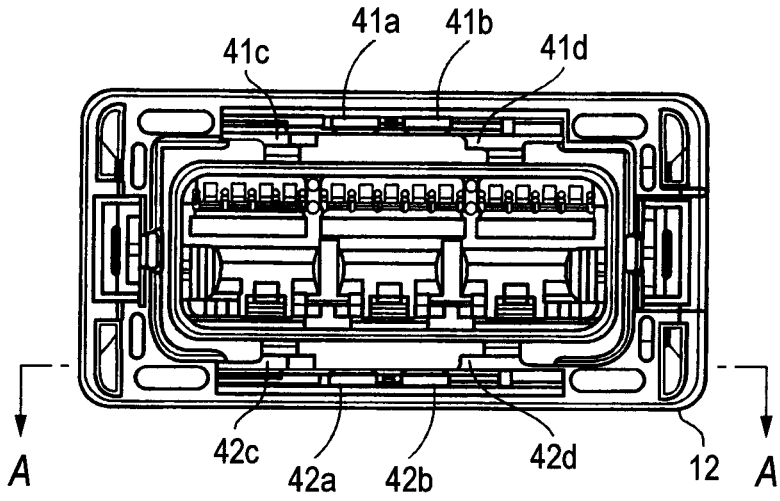
FIG. 3 A is a bottom view showing the manner of mounting a lever on a housing.
FIG. 3B is a cross-sectional view taken along the line A-A of FIG. 3A
Figure 3B:
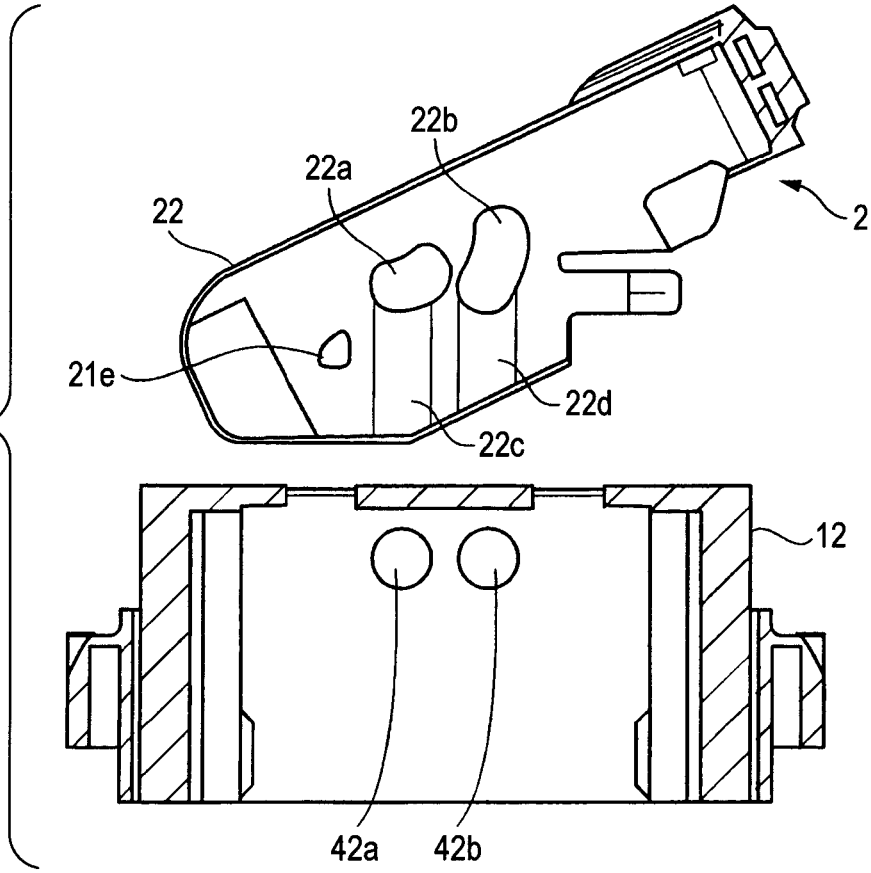

As shown in FIGS. 3A and 3B, the hood portion 13 of the housing 12 has housing bosses 41*a*, 41*b*, 42*a* and 42*b*, and the flat plate-like member 22 has engagement portions 22*a* and 22*b* (FIG. 3A is a bottom view of the housing 12, and FIG. 3B is a cross-sectional view taken along the line A-A of FIG. 3A).

The housing bosses 42*a* and 42*b* project inwardly from an inner peripheral surface of the hood portion 13 (that is, project from the reverse side to the front side in FIG. 3B). The engagement portions 22*a* and 22*b* are adapted to be engaged with the housing bosses 42*a* and 42*b*, respectively. Similarly, engagement portions 21a and 21b (FIG. 2) are formed at the flat plate-like member 21, and the housing bosses 41*a* and 41*b* are adapted to be engaged with the engagement portions 21*a* and 21*b*, respectively.

The engagement portions 21*a* and 21*b* are engaged respectively with the housing bosses 41*a* and 41*b*, and also the engagement portions 22*a* and 22*b* are engaged respectively with the housing bosses 42*a* and 42*b*, and as a result the lever 2 is supported on the housing 12 so as to be pivotally moved about the housing bosses 41*a* and 41*b* and the housing bosses 42*a* and 42*b*.

Figure 4A:
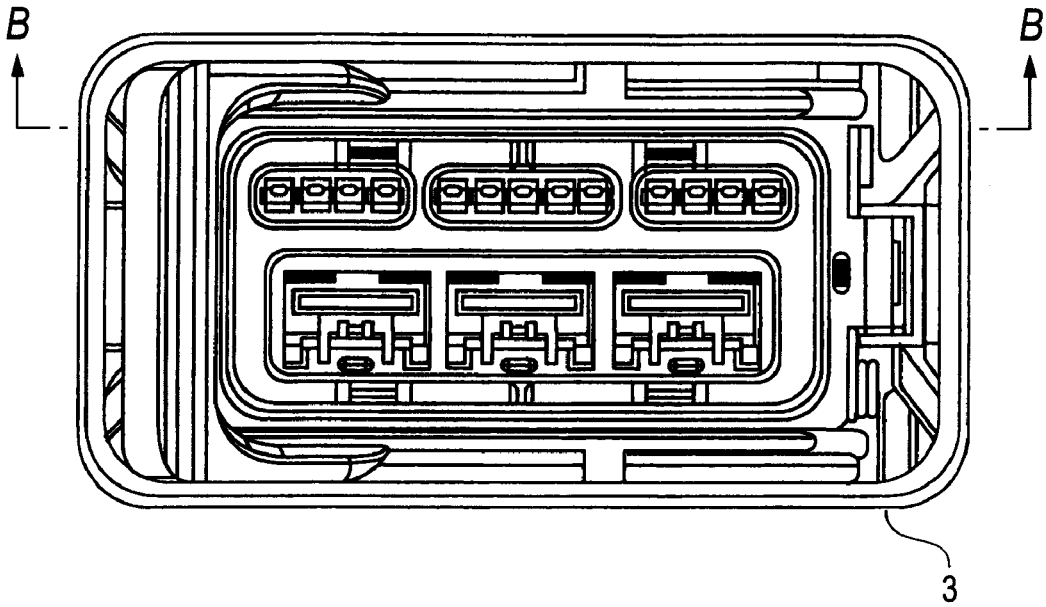
FIG. 4A is a top plan view showing the manner of fitting the lever-fitting type connector to the mating connector.
Figure 4B:
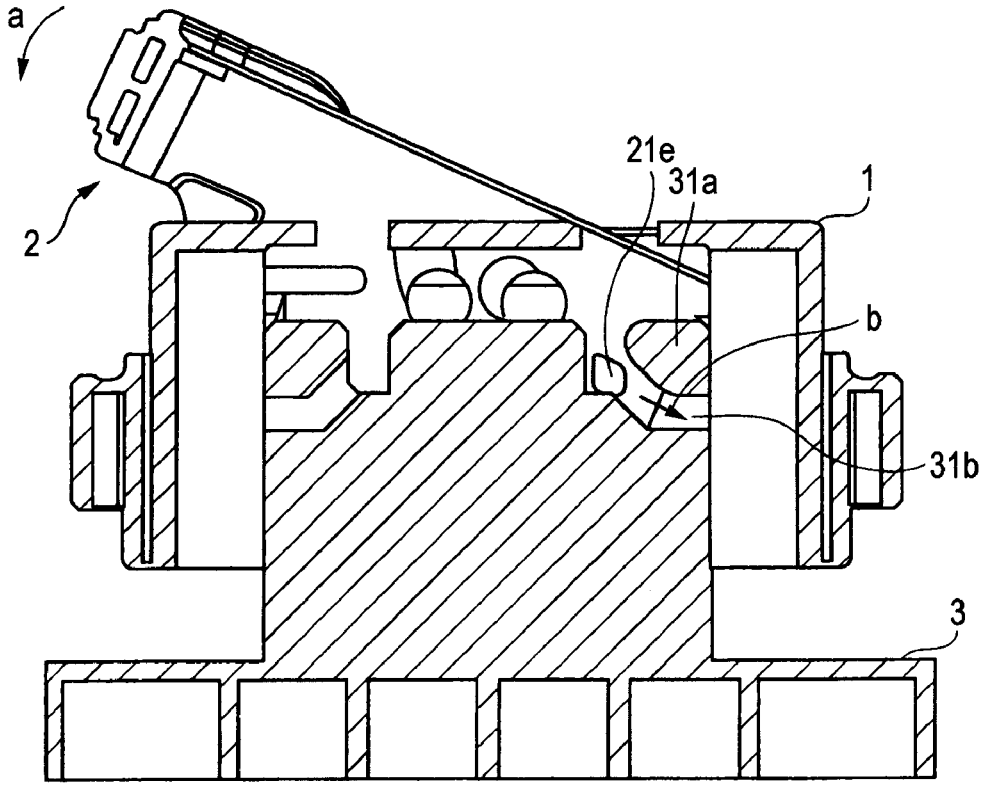
FIG. 4B is a cross-sectional view taken along the line B-B of FIG. 4A.

As shown in FIG. 4B, a lever boss 21*e* is formed at the lever 2, and retaining bosses 31*a* are formed at the mating connector 3 (FIG. 4A is a top plan view of the lever-fitting type connector 1, and FIG. 4B is a cross-sectional view taken along the line B-B of FIG. 4A. Each retaining portion is formed by the retaining boss 31*a* and a guide groove 31*b* (described later).). The worker fits the lever-fitting type connector 1 to the mating connector 3 to a certain degree, and then when the worker lowers the lever 2 in a direction of arrow a, the lever boss 21*e* moves in a direction of arrow b. Namely, the lever boss 21*e*, while pushing the retaining boss 31*a* upward, advances in and along the guide groove 31*b*, and therefore at this time the fitting of the lever-fitting type connector 1 to the mating connector 3 proceeds.

Then, the lever 2 is completely brought down, and the lever boss 21*e* reaches an inner end portion of the guide groove 31*b*, so that an upper surface of the lever boss 21*e* is retainingly engaged with a lower surface of the retaining boss 31*a*, and as a result the lever-fitting type connector 1 is moved or drawn toward the mating connector 3, so that the lever-fitting type connector 1 and the mating connector 3 are completely fitted together.

The structures of the lever-fitting type connector 1 and mating connector 3 as well as the fitting operation thereof are well known, and similar structures and fitting operation are described, for example, in JP-A-2005-122942.

Figure 5:
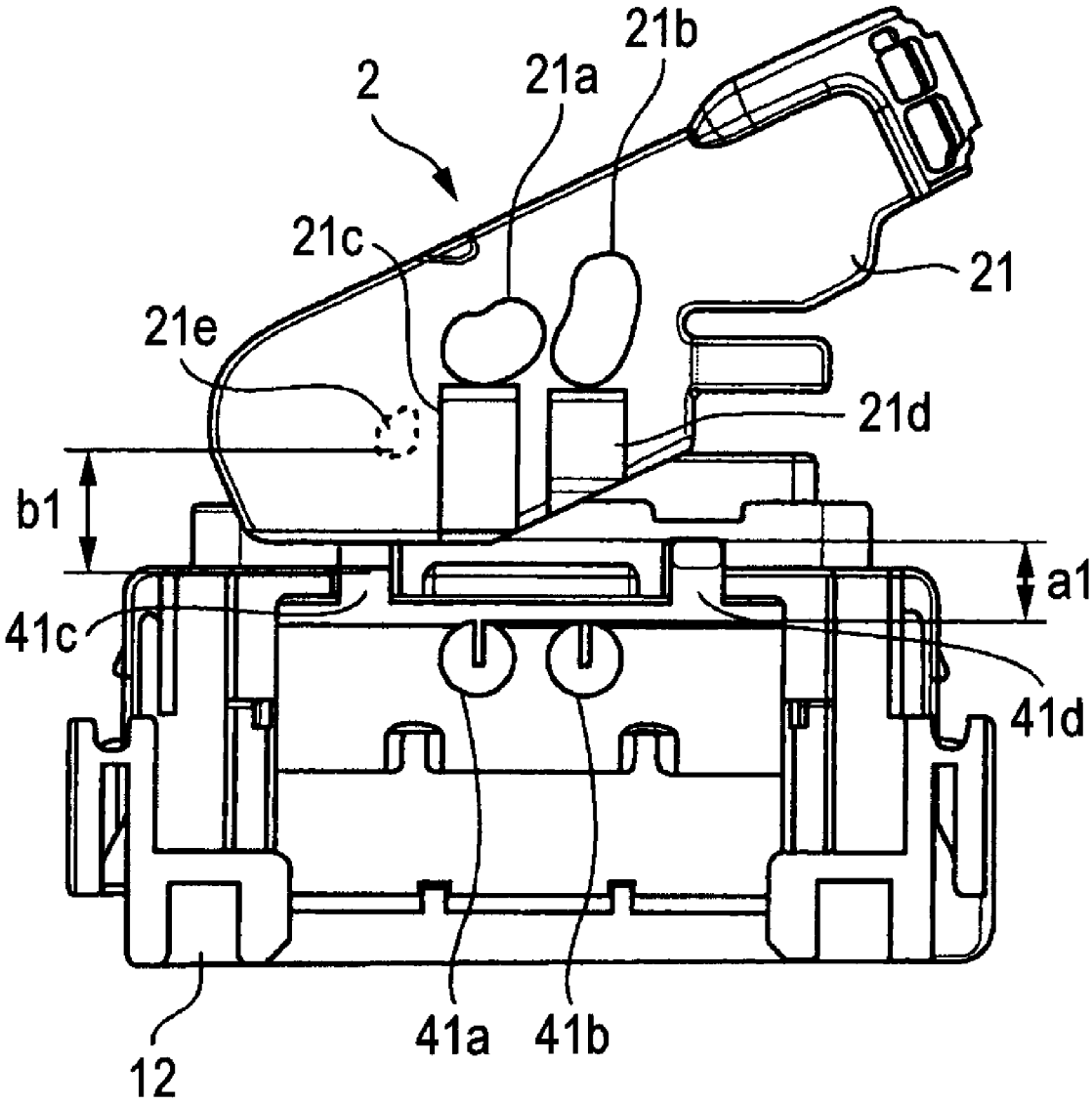
FIG. 5 is a view showing the positional relationship of groove portions, a lever boss, etc.

The present invention seeks to provide the structure in which the lever 2 can be easily inserted into the housing 12 in the process of producing the lever-fitting type connector 1. As shown in FIGS. 2 and 5, groove portions 21*c* and 21*d* are formed in the flat plate-like member 21 of the lever 2, and these groove portions 21*c* and 21*d* guide the insertion of the lever 2 relative to the housing bosses 41*a* and 41*b* at the time when the worker inserts the lever 2 into the housing 12.

Namely, the grooves portions 21*c* and 21*d* are one example of guide portions, and the groove portion 21*c* is formed in the flat plate-like member 21, and extends from the lower side of the engagement portion 21*a* to a lower edge (peripheral edge portion) of the flat plate-like member 21 along the direction of inserting of the lever 2. A width of the groove portion 21*c* corresponds to the diameter of the housing boss 41*a*, and a depth of the groove portion 21*c* is determined according to the height of the housing boss 41*a*.

Similarly, the groove portion 21*d* extends from the lower side of the engagement portion 21*b*. Further, groove portions 22*c* and 22*d* are also formed in the flat plate-like member 22 as described above for the flat plate-like member 21.

Further, relief portions 41*c*, 41*d*, 42*c* and 42*d* (FIG. 3A and FIG. 5) are formed at the housing 12. These relief portions 41*c*, 41*d*, 42*c* and 42*d* are spaces formed between the female terminal-receiving portion 11 and the hood portion 13. When inserting the lever 2 into the housing 12, the worker passes the lever boss 21*e* through one of the relief portions 41*c* and 41*d*, and also passes a lever boss 22*e* through that relief portion 42*c*, 42*d* which corresponds in position to the one relief portion 41*c*, 41*d* (through which the lever boss 21*e* passes). (In FIG. 3A, for example, walls disposed at the right and left sides of the relief portion 41*c*, 41*d*, that is, wall-like portions (contacting the lever 2) excluding the relief portions 41*c*, 41 d prevent the lever 2 from tilting inwardly.) One feature of the lever-fitting type connector 1 of the invention is the positional relation between the groove portion 21*c*, the housing boss 41*a*, the lever boss 21*e* and the relief portion 41*c* which is obtained at the time of starting the insertion of the lever 2 into the housing 12. Namely, as shown in FIG. 5, the various portions are formed such that the distance al between the lower end of the groove portion 21*c* and the upper end of the housing boss 41*a* is smaller than the distance b1 between the lower end of the lever boss 21*e* and the upper end of the relief portion 41*c*.

Because of this positional relationship of the various portions, the guiding by the groove portions 21*c* and 22*c* is initiated at the time of inserting the lever 2 into the housing 12, and the lever boss 21*e* begins to pass through the relief portion 41*c*, with the lever 2 prevented from moving in a direction perpendicular to the inserting direction. Therefore, the worker can more smoothly mount the lever 2 on the housing 12 in a shorter time.

For example, there can be prevented a disadvantageous situation in which it is difficult to position the lever 2 relative to the housing 12 after only the lever boss 21*e* is moved into the housing 12 through the relief portion 41*c*. The worker can smoothly mount the lever 2 on the housing 12 in a short time.

In this embodiment, the lever 2 is formed into the U-shape, and in other words the lever 2 comprises the flat plate-like members 21 and 22, and the interconnecting member 23 interconnecting the flat plate-like members 21 and 22, and in addition to the groove portions 21*c* and 22*c*, the groove portions 21*d* and 22*d* are formed. With this construction, the lever 2 can be guided more stably.

Second Embodiment

Figure 6:
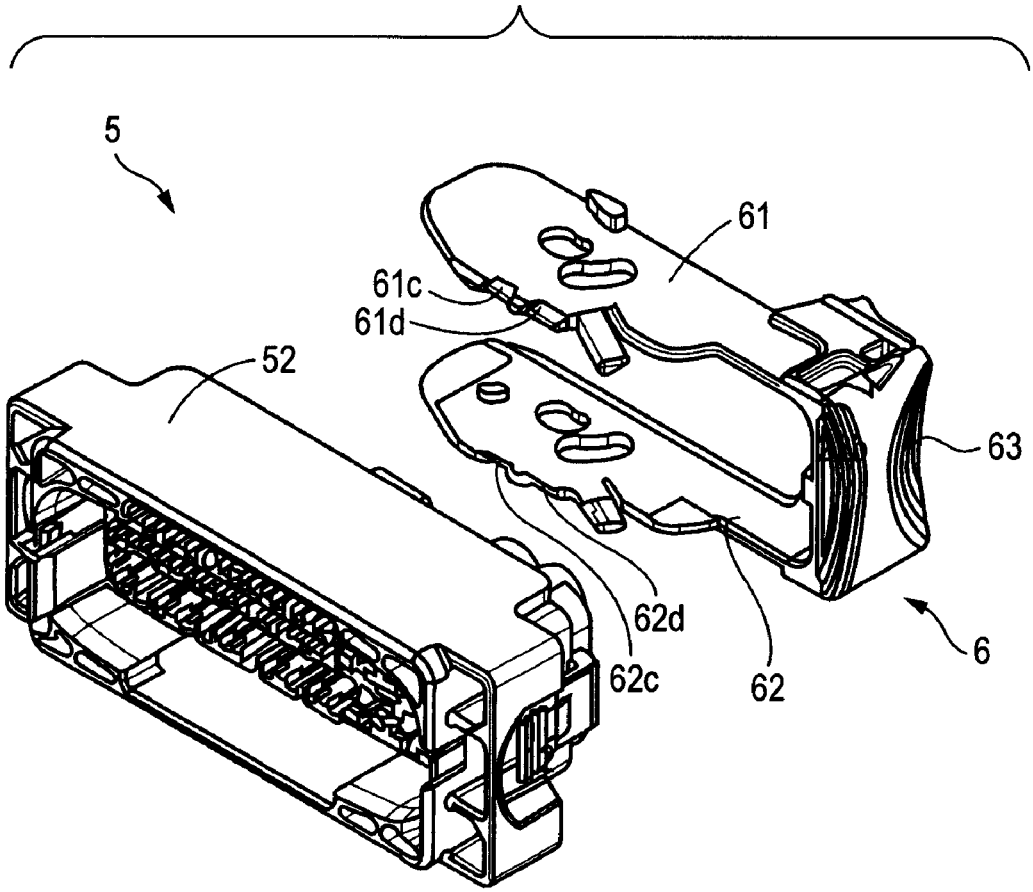
FIG. 6 is an exploded perspective view of a second embodiment of a lever-fitting type connector of the invention.

Next, a second embodiment of a lever-fitting type connector of the invention will be described. As shown in FIG. 6, this embodiment differs from the first embodiment in that instead of the groove portions 21*c* and 21*d*, notch portions 61*c* and 61*d* are formed at a lever 6, and also instead of the groove portions 22*c* and 22*d*, notch portions 62*c* and 62*d* are formed at the lever 6. This second embodiment is generally similar in construction, advantageous effects, etc., to the first embodiment except the construction, advantageous effects, etc., of the lever 6 described later.

Figure 7:
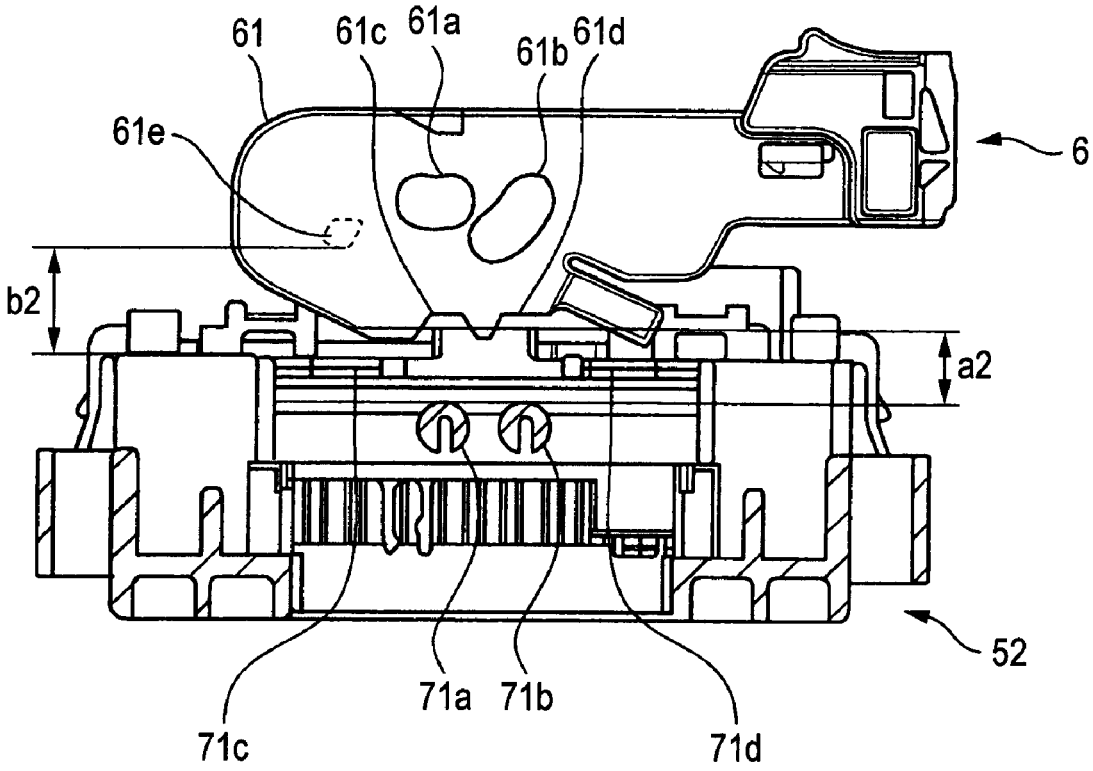
FIG. 7 is a view showing the positional relationship of notch portions, a lever boss, etc.

The lever-fitting type connector 5 comprises the lever 6, and a housing 52. The lever 6 includes flat plate-like members 61 and 62, and an interconnecting member 63 as in the first embodiment. As shown in FIG. 7, the flat plate-like member 61 has engagement portions 61*a* and 61*b* and the notch portions 61*c* and 61*d*.

The engagement portions 61*a* and 61*b* are adapted to be engaged respectively with housing bosses 71*a* and 71*b* formed on the housing 52, and the notch portions 61*c* and 61*d* are adapted to guide the insertion of the lever 6 into the housing 52.

The notch portions 61*c* and 61*d* are another example of the guide portions, and the notch portion 61*c* is formed in that portion of a lower edge (peripheral edge) of the flat plate-like member 61 aligned with the engagement portion 61*a* in a direction of inserting of the lever 6. The shape of this notch portion 61*c* is determined according to the shape of an upper portion of the housing boss 71*a*.

Similarly, the notch portion 61*d* is formed in that portion of the lower edge (peripheral edge) of the flat plate-like member 61 aligned with the engagement portion 61*b* in the direction of inserting of the lever 6. Similarly, the notch portions 62*c* and 62*d* are also formed in the flat plate-like member 62.

In this embodiment, at the time of starting the insertion of the lever 6 into the housing 52, the distance a2 between each notch portion 61*c*, 61*d* and the corresponding housing boss 71*a*, 71*b* is smaller than the distance b2 between a lower end of a lever boss 61*e* and an upper end of a relief portion 71*c* as shown in FIG. 7. Namely, the positional relation between the notch portions 61*c* and 61*d*, the housing bosses 71*a* and 71 *b*, the lever boss 61*e* and the relief portion 71*c* is so determined that at the time of inserting the lever 6 into the housing 52, the lever boss 61*e* can begin to pass through the relief portion 71*c* after the guiding by the notch portions 61*c* and 61*d* is initiated.

Figure 8A:
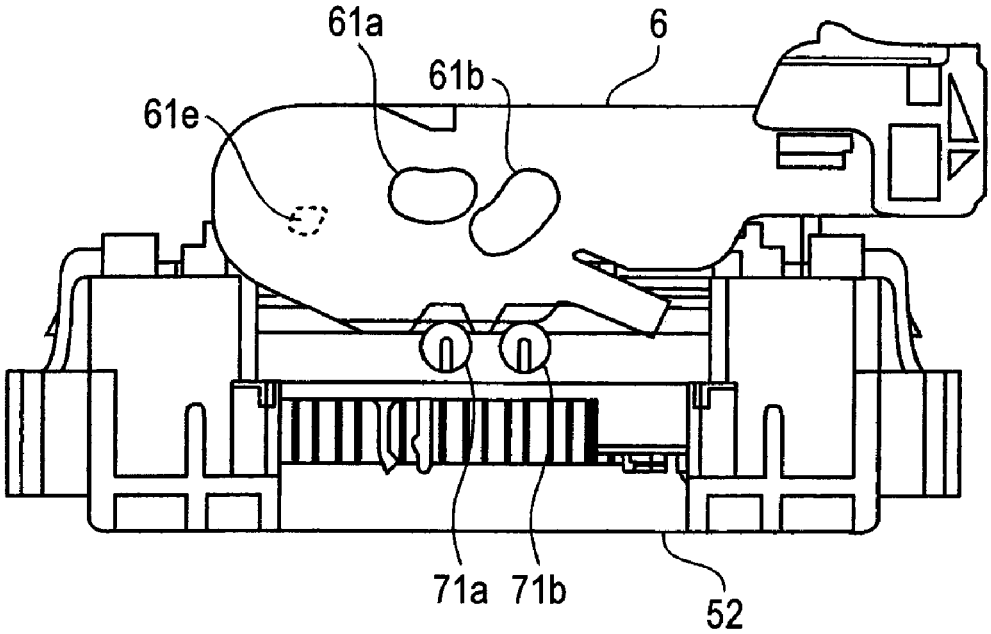
FIG. 8A, B are views showing the manner of mounting a lever on a housing.
Figure 8B:
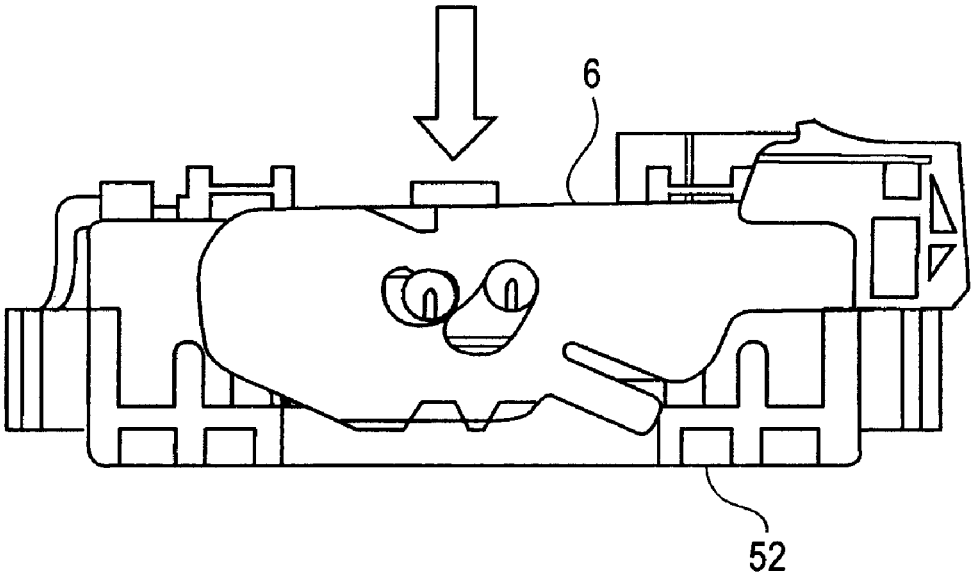

With this construction, a pushing force applied to the lever 6 by the worker concentrates on the vicinities of the upper ends of the notch portions 61*c* and 61*d*, and therefore the worker can fit the housing bosses 71*a* and 71*b* into the respective engagement portions 61*a* and 61*b* in one breath (FIG. 8A, and FIG. 8B). In accordance with this fitting operation, the lever boss 61*e* passes through the relief portion 71*c* at the upper portion of the housing 52 without particularly letting the worker be conscious of this.

In this embodiment, also, the lever 6 can be smoothly inserted into the housing 52 as in the preceding embodiment.

Other Embodiments, etc.

Although the present invention has been described above by way of the specific embodiments, the invention is not limited to the above embodiments, and various modifications can be made without departing from the subject matter of the invention.

A. For example, although the engagement portions 21*a*, 21*b*, 22*a*, 22*b* and so on are each in the form of a through hole, each of these engagement portions may be in the form of a recessed portion deeper than the groove portions 21*c*, 21*d*, 22*c* and 22*d*.

B. Although the lever 2 is formed into the U-shape, using the two flat plate-like members 21 and 22, it may be replaced by a lever comprising a single flat plate-like-member.

C. Although the two engagement portions (for example, 21*a* and 21*b*) are formed in the flat plate-like member (21), only one engagement portion may be formed in the flat plate-like member.

D. Although the notch portion 61*c*, 61*d* has a trapezoidal shape or the shape defined by interconnected straight lines, it may have any other suitable shape such as a semi-circular shape and a semi-oval shape or may have a shape defined by interconnected curved lines.

E. Naturally, the groove portions and the notch portions may be formed at the lever. In this case, the lever can be more smoothly and stably mounted on the housing.

What is claimed is:

1. A lever-fitting type connector comprising:

a housing, connectable to a mating connector, and formed with an inwardly-projecting housing boss; and a lever, including an engagement portion engageable with the housing boss, and a lever boss retaining engagement with a retaining portion formed on the mating connector;

wherein a guide portion guiding the insertion of the lever into the housing is formed at the lever, and a relief portion for the passage of the lever boss therethrough during the insertion is formed at the inside of the housing;

wherein, at the time of starting the insertion of the lever into the housing, the distance between the guide portion and the housing boss is smaller than the distance between the lever boss and the relief portion.

2. The lever-fitting type connector according to claim 1, wherein the guide portion includes a groove portion extending from the engagement portion to a peripheral edge of the lever along a direction of inserting of the lever.

3. The lever-fitting type connector according to claim 1, wherein the guide portion includes a notch portion formed in that portion of the peripheral edge of the lever aligned with the engagement portion in the direction of inserting of the lever.

* * * * *